US008239976B2

(12) United States Patent
Chen et al.

(10) Patent No.: US 8,239,976 B2
(45) Date of Patent: Aug. 14, 2012

(54) DUAL FLOW TOILET ADJUSTMENT SYSTEM

(75) Inventors: Weizhi Chen, Northfield, IL (US); Suzy Zeng, Northfield, IL (US)

(73) Assignee: Z-Choice International, LLC, Northfield, IL (US)

( * ) Notice: Subject to any disclaimer, the term of this patent is extended or adjusted under 35 U.S.C. 154(b) by 672 days.

(21) Appl. No.: 12/403,481

(22) Filed: Mar. 13, 2009

(65) Prior Publication Data

US 2010/0229294 A1 Sep. 16, 2010

(51) Int. Cl.
*E03D 1/22* (2006.01)
*E03D 1/14* (2006.01)
*E03D 3/12* (2006.01)

(52) U.S. Cl. ..... 4/364; 4/324; 4/346

(58) Field of Classification Search ..... 4/324, 325, 4/345, 346, 363, 364, 415
See application file for complete search history.

(56) References Cited

U.S. PATENT DOCUMENTS

| | | | | | |
|---|---|---|---|---|---|
| 830,280 | A | * | 9/1906 | Alexander | 4/346 |
| 3,812,544 | A | * | 5/1974 | Risley | 4/415 |
| 3,839,746 | A | | 10/1974 | Kowalski | |
| 3,945,056 | A | | 3/1976 | Kowalski et al. | |
| 4,080,667 | A | * | 3/1978 | Walsh et al. | 4/415 |
| 4,144,600 | A | * | 3/1979 | Mayes | 4/324 |
| 4,219,895 | A | | 9/1980 | Thompson | |
| 4,225,985 | A | * | 10/1980 | Joshi et al. | 4/324 |
| 4,250,579 | A | * | 2/1981 | Moon | 4/415 |
| 4,388,737 | A | * | 6/1983 | Wenzel | 4/415 |
| 4,419,772 | A | | 12/1983 | Smith | |
| 4,868,933 | A | | 9/1989 | Chen | |
| 5,111,537 | A | | 5/1992 | Zaruba | |
| 5,369,816 | A | * | 12/1994 | Chen | 4/408 |
| 6,282,731 | B1 | | 9/2001 | Mohrman | |
| 6,571,400 | B1 | * | 6/2003 | Reid | 4/364 |
| 2002/0157177 | A1 | | 10/2002 | Sakura | |

* cited by examiner

*Primary Examiner* — David Dunn
*Assistant Examiner* — Danielle Jackson
(74) *Attorney, Agent, or Firm* — Adam K. Sacharoff

(57) ABSTRACT

In one embodiment of the present system invention, there is provided a dividing module positioned in the holding tank of a toilet to separate the holding tank into a main portion and a reserve portion. The dividing module has a height lower than the full water level in the holding tank. The dividing module includes the ability to selectively connect the main portion and the reserve portion in fluid communication of each other. The embodiment allows an operator to press the handle arm an initial time to maintain the main portion and the reserve portion in substantially fluid separation of each other, such that water in the main portion is utilized to flush the toilet and wherein when the operator presses the handle a second time in the same manner as the initial time, the dividing module connects the main portion and the reserve portion in substantially fluid communication with each other, such that water in the reserve portion and the main portion is utilized to flush the toilet.

16 Claims, 13 Drawing Sheets

DUAL FLOW TOILET ADJUSTMENT SYSTEM

FIELD OF THE INVENTION

The present invention relates generally to toilets and more specifically to a dual flow toilet bowl water flow adjustment system for controlling the volume of water in the holding tank used to flush a water-flush toilet.

BACKGROUND OF THE INVENTION

Water shortage is becoming a concern in many parts of the world including United States which uses the greatest amount of residential water in the world. In growing times of water shortages, the problem of having sufficient water supplies will most likely continue to get worse. A toilet uses the largest amount of water in the United States, representing more than ⅓ of the total household water used. According to Environmental Protection Agency (EPA), billions of gallons of water can be saved annually if toilet water usage in the United States can be reduced by ⅓. In fact, more than 640 billion gallons of water can be saved annually if the older model toilets in the United States can be replaced with the newer water efficient toilets.

Low flow toilets use 1.6 gallons per flush (gpf), which is compared to a conventional toilet which uses 3.5 to 7 gpf. Low flow toilets are simply designed to help reduce toilet water usage. Unfortunately, research shows that many of these low flow toilets actually waste more water than they are designed for. The key issue is that they do not release adequate amount of water to clear the waste. Consumers often have to flush two or three times more to clear the wastes.

To increase performance some of the newer low flow toilets use air pressure to help clear wastes. These "High Efficiency Toilets" (HET) clear wastes effectively, but the air pressure has a tendency to splash waste water causing droplets to become airborne. Another issue related to the HET toilets is a significant increase in noise during flushing. In addition, these toilets treat liquid waste the same as the solid waste. These problems tend to make these more expensive devices not practical for the average household.

Dual flush toilets have gained in popularity in recent years. These toilets treat liquid and solid wastes differently as they should. They provide two types of flushes, short flush (less water) for liquid waste and standard flushes for solid waste. While dual flush toilets are more effective than the low flow toilet in saving water, they tend to be more expensive requiring several years of payback period for consumers. Dual flush toilets are also designed with different mechanisms from the conventional toilets, therefore they are also more expensive for manufacturers to make due to replacement of the existing manufacturing equipment, purchase, and installation of new equipment. Prematurely replacing existing conventional toilets with dual flush toilets also creates environmental issues due to early disposal of the existing toilets to the landfill.

Dual flush toilet retrofit kits which convert existing conventional toilets into dual flush toilets can be a good alternative because they tend to be significantly cheaper than buying a new dual flush toilet and they do not require replacing the existing toilet. However, almost all retrofit kits currently on the market require replacing certain parts of the existing toilet and often need a professional plumber to complete the installation, which adds significant cost to consumers.

In these respects, one or more embodiments of the present invention substantially depart from the conventional concepts and designs of the prior art, and in so doing provide an apparatus/system primarily developed for the purpose of controlling the water volume utilized to flush an existing toilet or new toilet. The apparatus/system accomplishes the task efficiently and cost effectively, and accomplishes the task without replacing any existing parts, and is a portable device.

SUMMARY OF THE INVENTION

One or more of the embodiments in the present invention is directed to a toilet water flow adjustment system for usage within a toilet. The toilet can be a typical set-up having a handle arm connected to a flush connector, which when the handle arm is depressed a main flapper valve opens to flush the toilet. The system as described in one or more of the embodiments would include a divider positionable within a holding tank in a substantially vertical orientation. The divider has a height lower than a full water level in the holding tank and the divider separates the holding tank into a main portion and a reserve portion. The main portion would preferably contain the main flapper valve. The divider is defined as including a gate panel positioned against at least one side panel. The side panel includes an aperture. The gate panel is vertically movable with respect to the at least one side panel for providing selective fluid connection between the main portion and the reserve portion when the gate panel is moved and maintained towards an upward position. A first linkage is provided to connect the gate panel to the flush connector such that when the handle arm is depressed, the gate panel moves towards an upward position.

The system also includes a lever preferably having a weighted object freely moveably secured thereto. The lever has one end connected to the gate panel and has another end connected to a float. The lever is further pivotally connected to a region intermediate to the two ends to the side panel, such that when the gate panel moves towards an upward position the float moves towards a downward position. The float is also positioned within the reserve portion or above the divider, or within the main portion, and maintains a floating position on the full water level above the height of the divider.

Therefore, when the handle arm is initially depressed the gate panel being initially urged towards an upward position returns to a downward position sealing the aperture in the divider because the float maintains the floating position on top of the full water level and because the weighted object substantially remains at the end connected to the gate panel. The initial pressing of the handle arm will use the water in the main portion to flush the toilet reserving water in the reserve portion. Additionally, when the handle arm is depressed a second time in the same manner as the initial depression the gate panel is moved towards an upward position dropping the float to a position about the height of the divider which causes the weighted object to move towards the end of the lever connected to the float, thereby maintaining the gate panel in an upward position and opening the aperture in the side panel such that the water in the reserve portion and the main portion is utilized to flush the toilet.

In various objects of the embodiment the vertical orientated divider may include at least two side panels separately positioned on either side of the gate panel (the gate panel can be the divider which does not need side panels but requires "guard rails" on the toilet walls, when the gate panel is lifted upwards, the main and reserve portions are connected). Each side panel would have an aperture defined to provide fluid connection between the main portion and the reserve portion when the gate panel is maintained in an upward position. Additionally, the two side panels may each include flanged edges extending towards each other, such that when the flanged edges of the two side panels are secured together, the two side panels create a cavity and wherein the cavity is sized to receive the gate panel. It is further provided that each panel has a pair of ends positioned to engage a side wall of the holding tank such that when engaged the side panel fluidly separates the holding tank into the main portion and the reserve portion, and the pair of ends may further include a gasket secured there along to facilitate the fluid separation.

In addition, each side panel may further include an anchor system to secure the divider in the holding tank.

Various other aspects of the embodiments may provide for the gate panel having a first member protruding upwardly from a top edge of the gate panel and the first member being secured to the first linkage; and the first member including a plurality of openings to adjustably secure the first linkage thereto. Yet other aspects include connecting the end of the lever distal to the end connected to the float to a second linkage which connects to the gate panel.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1A:
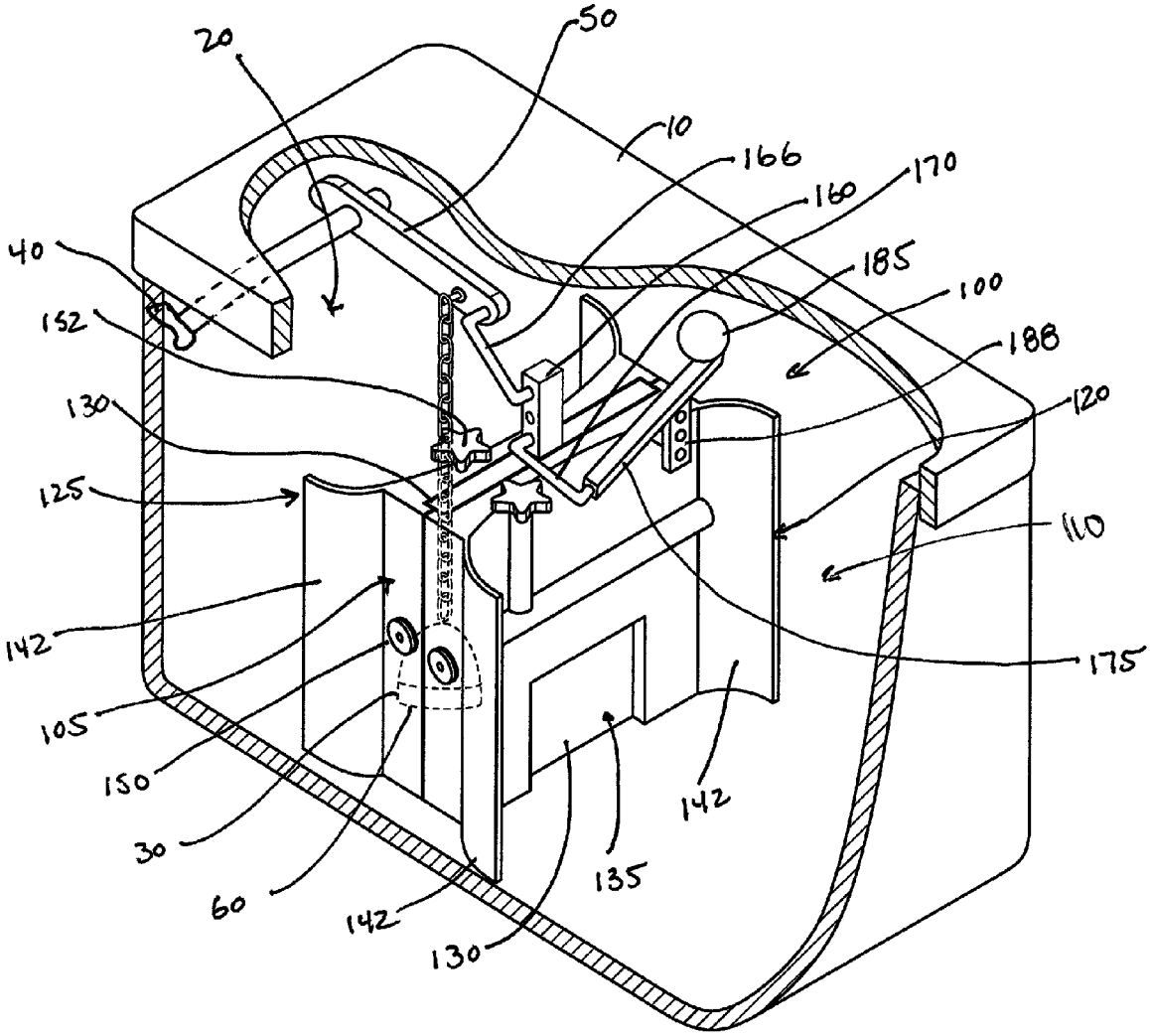
FIG. 1A is a perspective view of a first system embodiment made in accordance with one or more principals of the present invention.
Figure 1B:
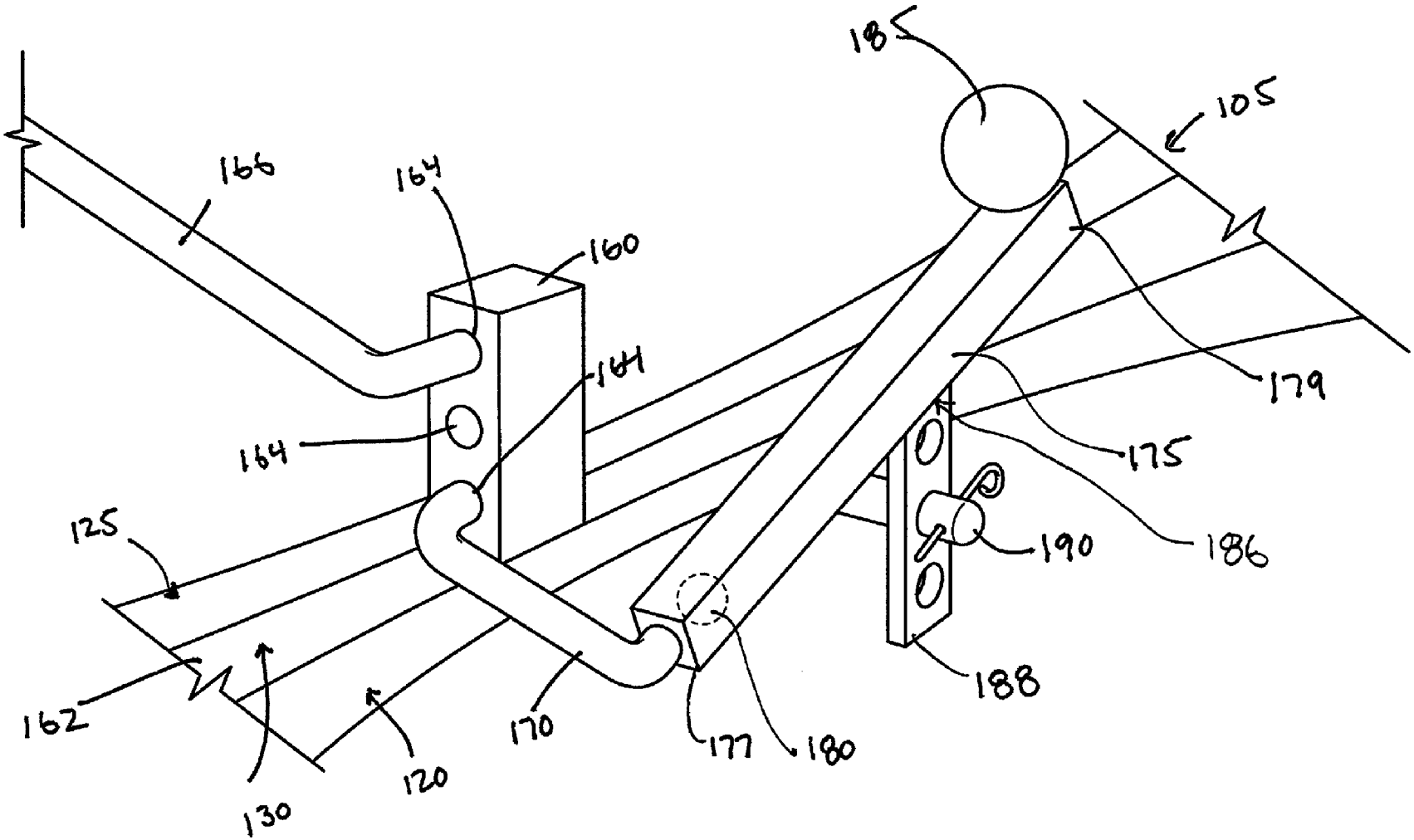
FIG. 1B is an enlarged perspective view of a top portion of a divider module in accordance with the FIG. 1A embodiment.
Figure 1C:
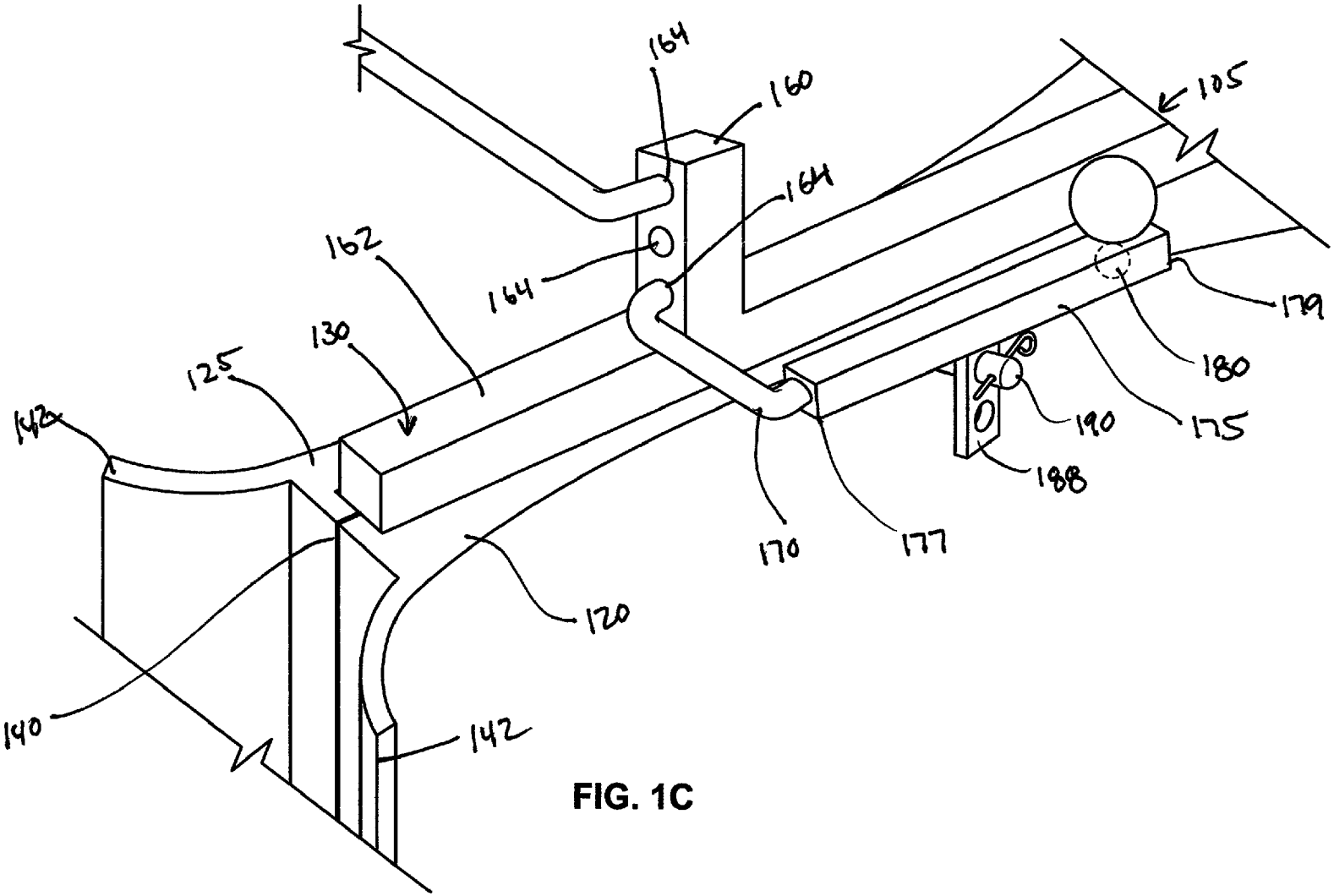
FIG. 1C is an enlarged perspective view of FIG. 1B illustrating a gate panel moved towards an upward position.
Figure 1D:
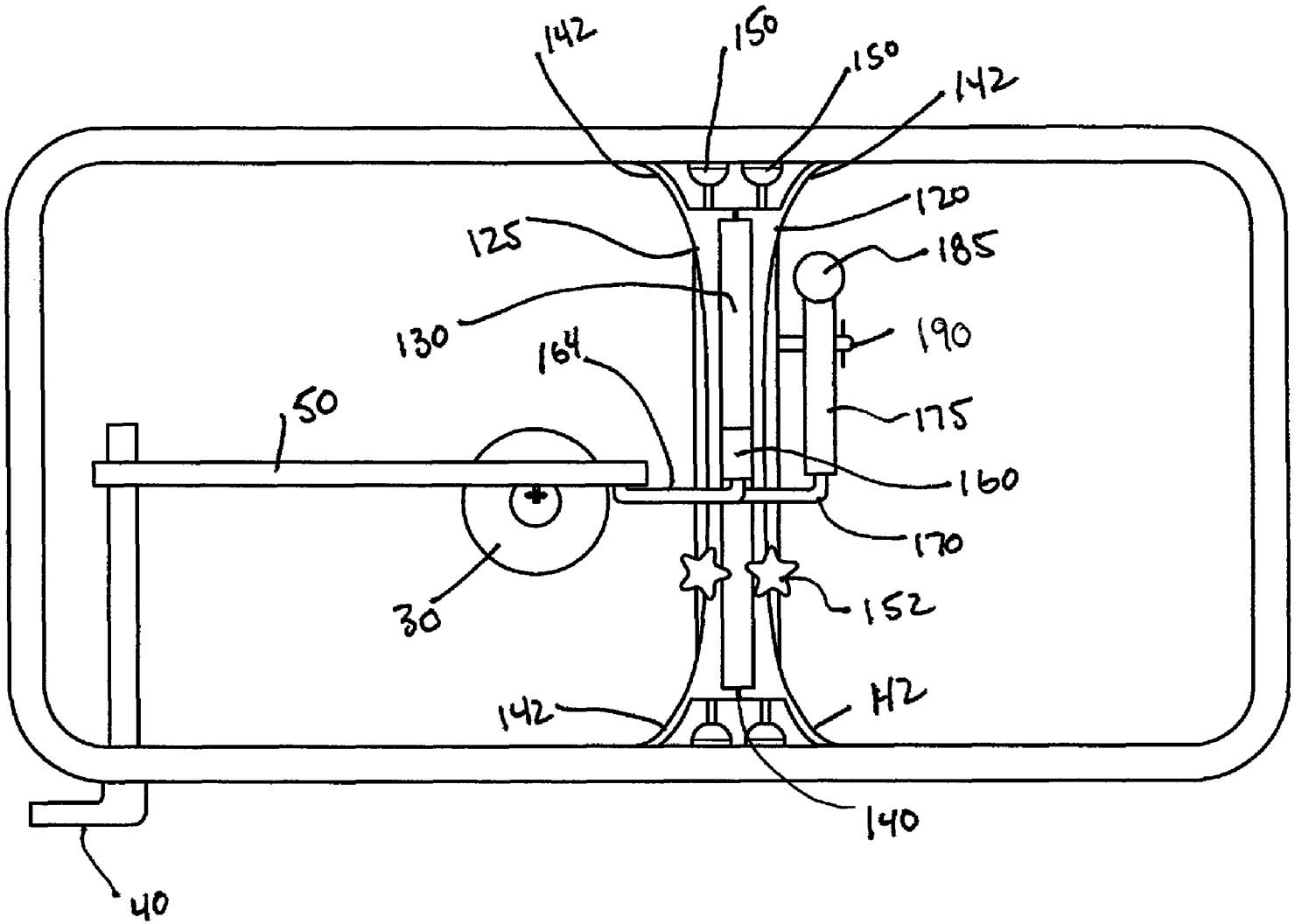
FIG. 1D is a top view of the FIG. 1A embodiment.
Figure 2A:
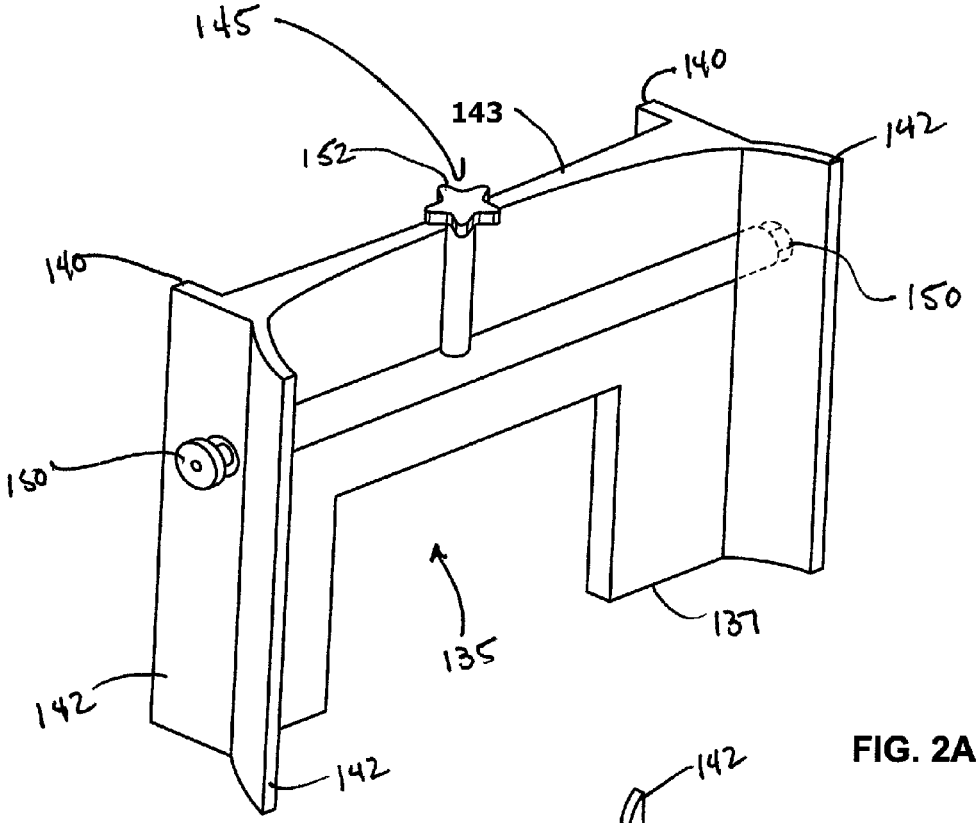
FIG. 2A is a perspective view of a side panel in accordance with the FIG. 1A embodiment.
Figure 2B:
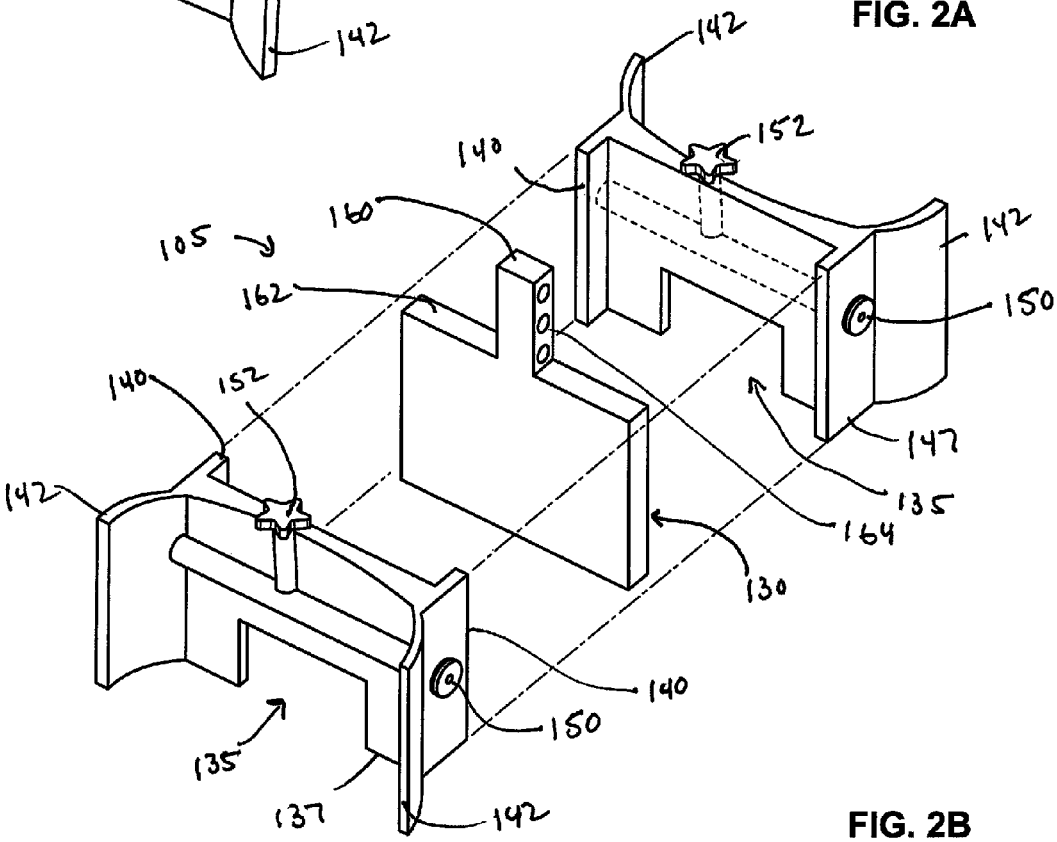
FIG. 2B is a perspective view of the relationship of connecting the gate panel with two side panels.
Figure 3A:
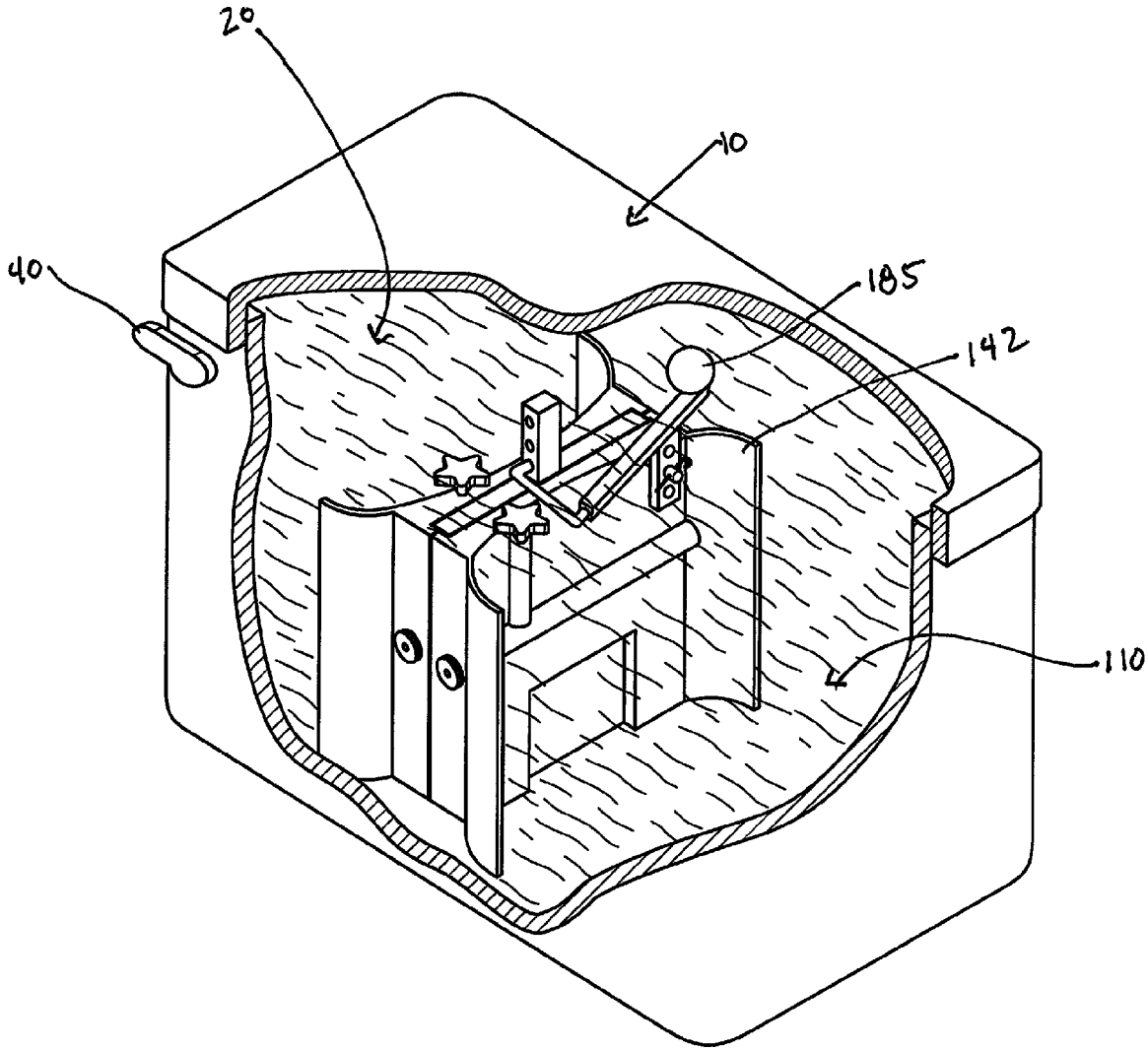
FIG. 3A is a perspective view of a holding tank with the first system embodiment showing a full water level.
Figure 3B:
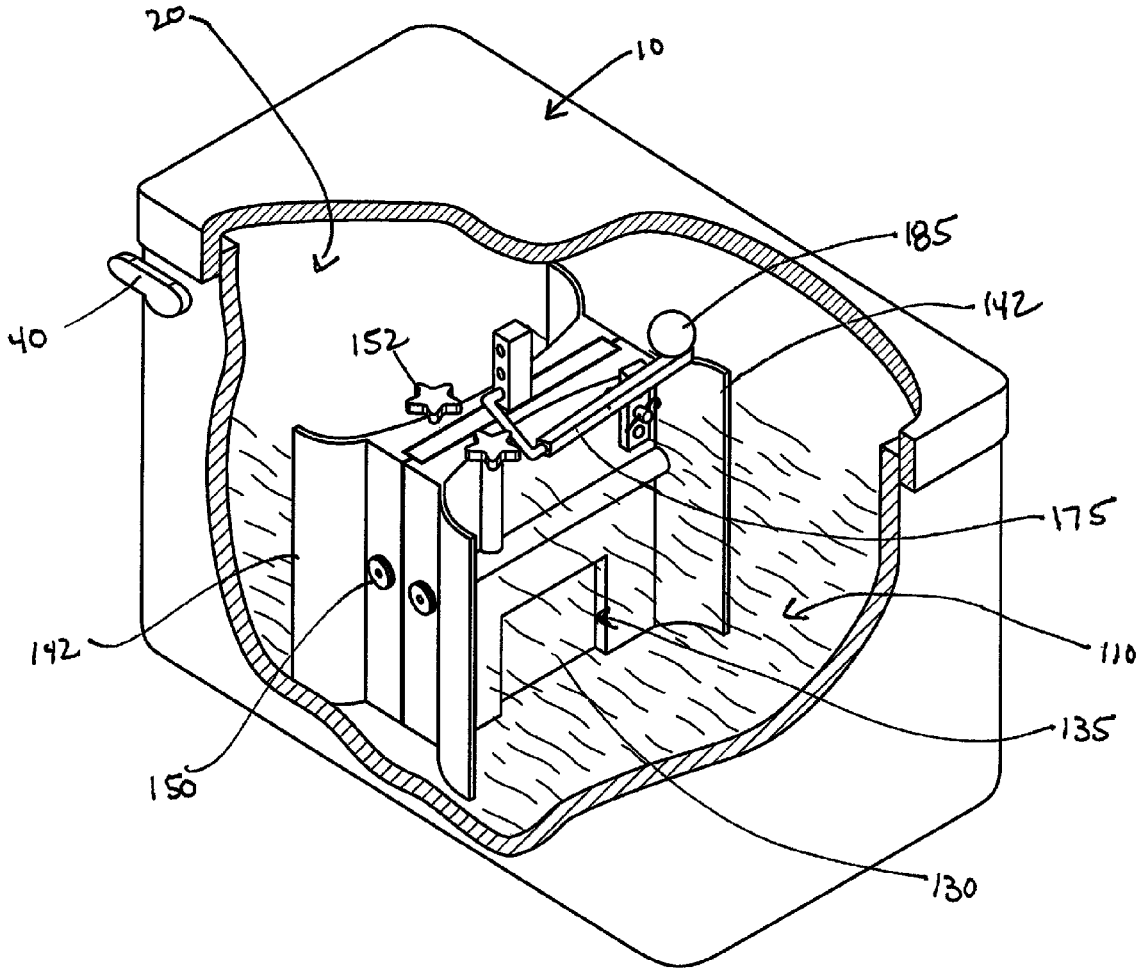
FIG. 3B is a perspective view of a holding tank with the first system embodiment showing an initial flush using the water from the main portion and maintaining the water level in the reserve portion.
Figure 3C:
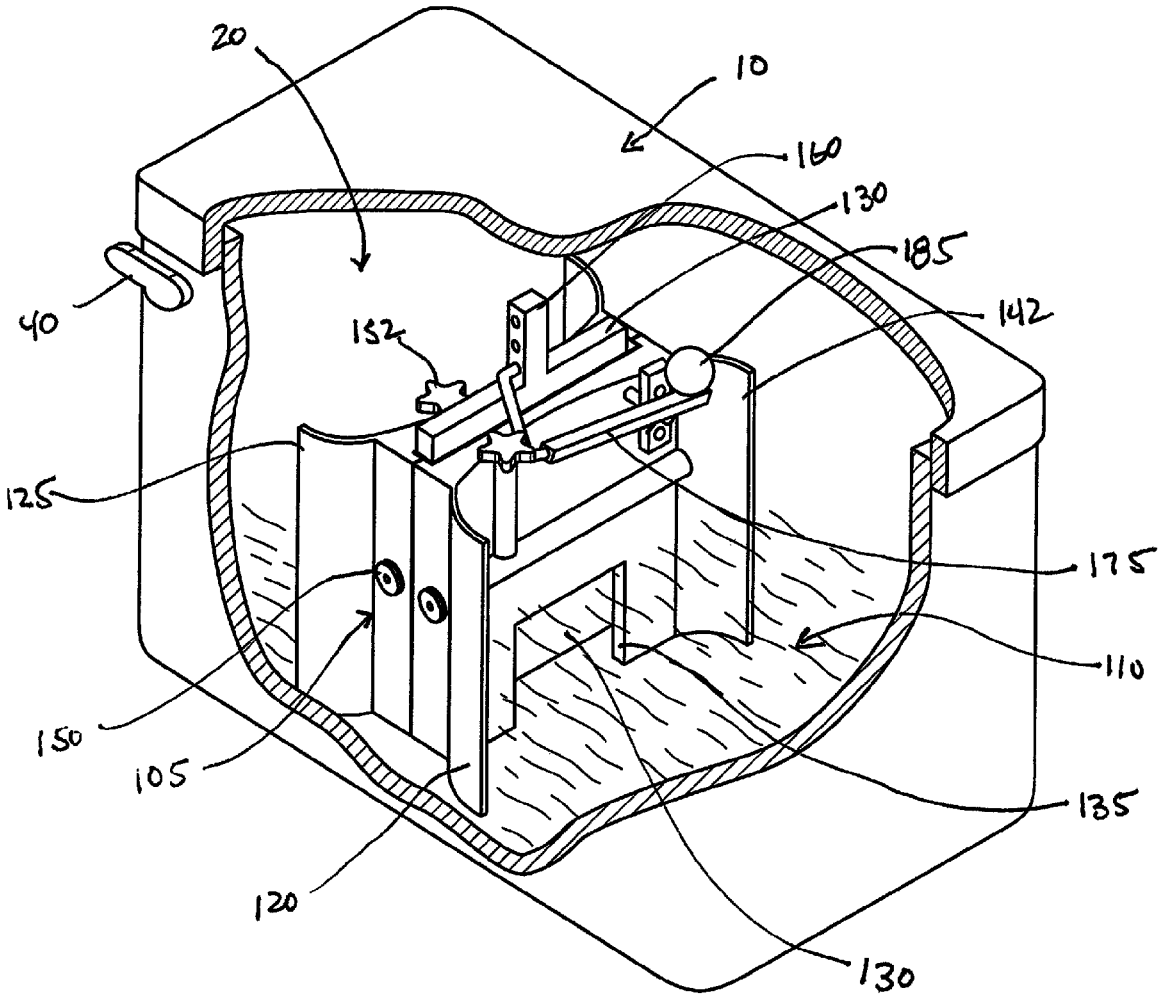
FIG. 3C is a perspective view of a holding tank with the first system embodiment showing a double flush using the water from both portions since the gate panel in maintained in an upward position.
Figure 4A:
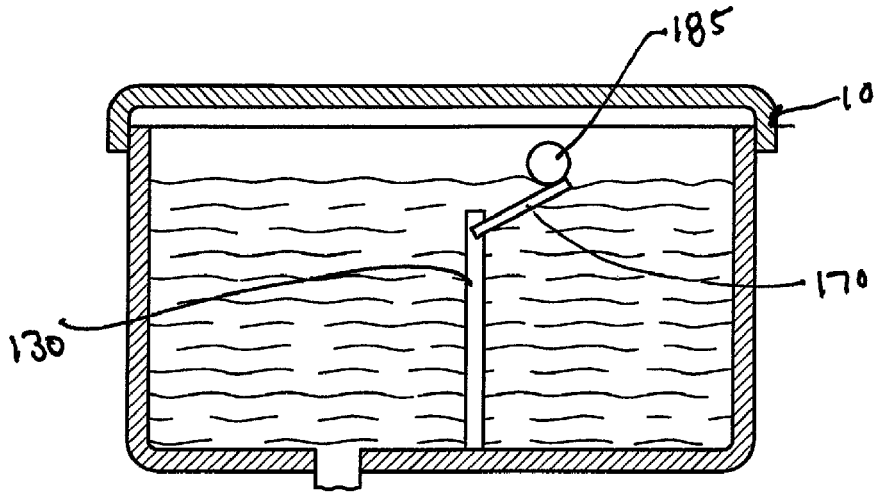
FIG. 4A is a side view of the system illustrated in FIG. 3A.
Figure 4B:
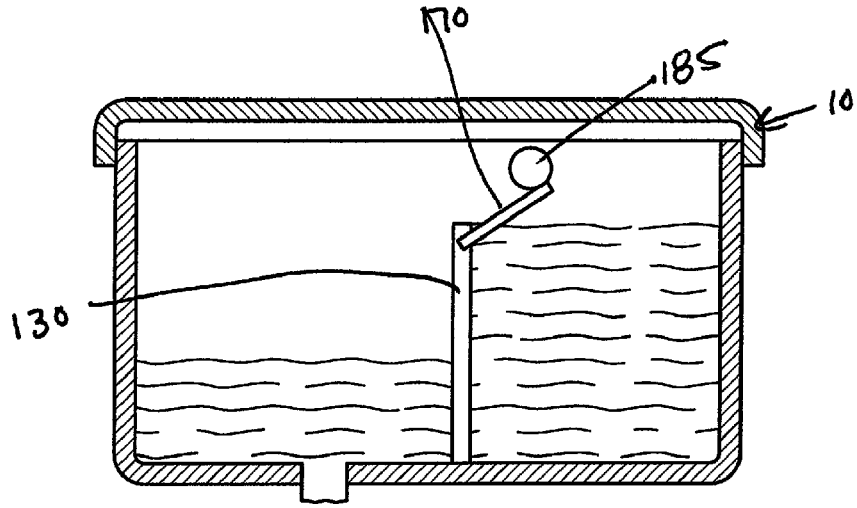
FIG. 4B is a side view of the system illustrated in FIG. 3B.
Figure 4C:
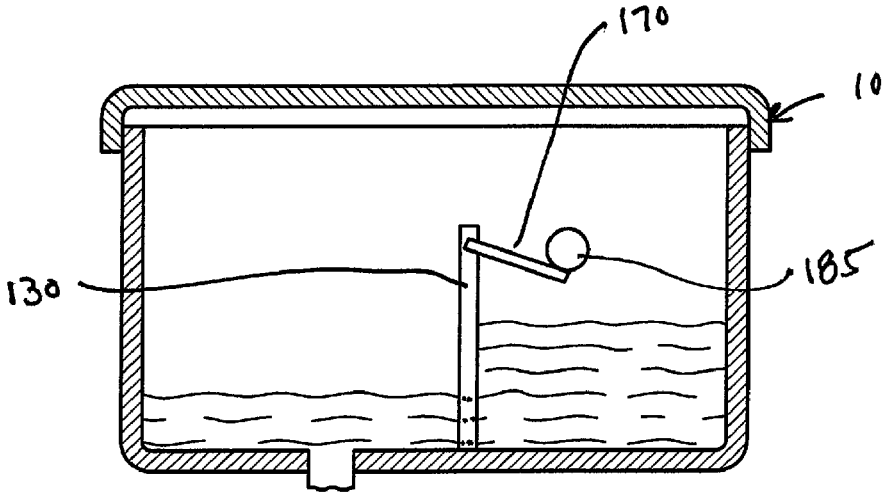
FIG. 4C is a side view of the system illustrated in FIG. 3C.
Figure 5A:
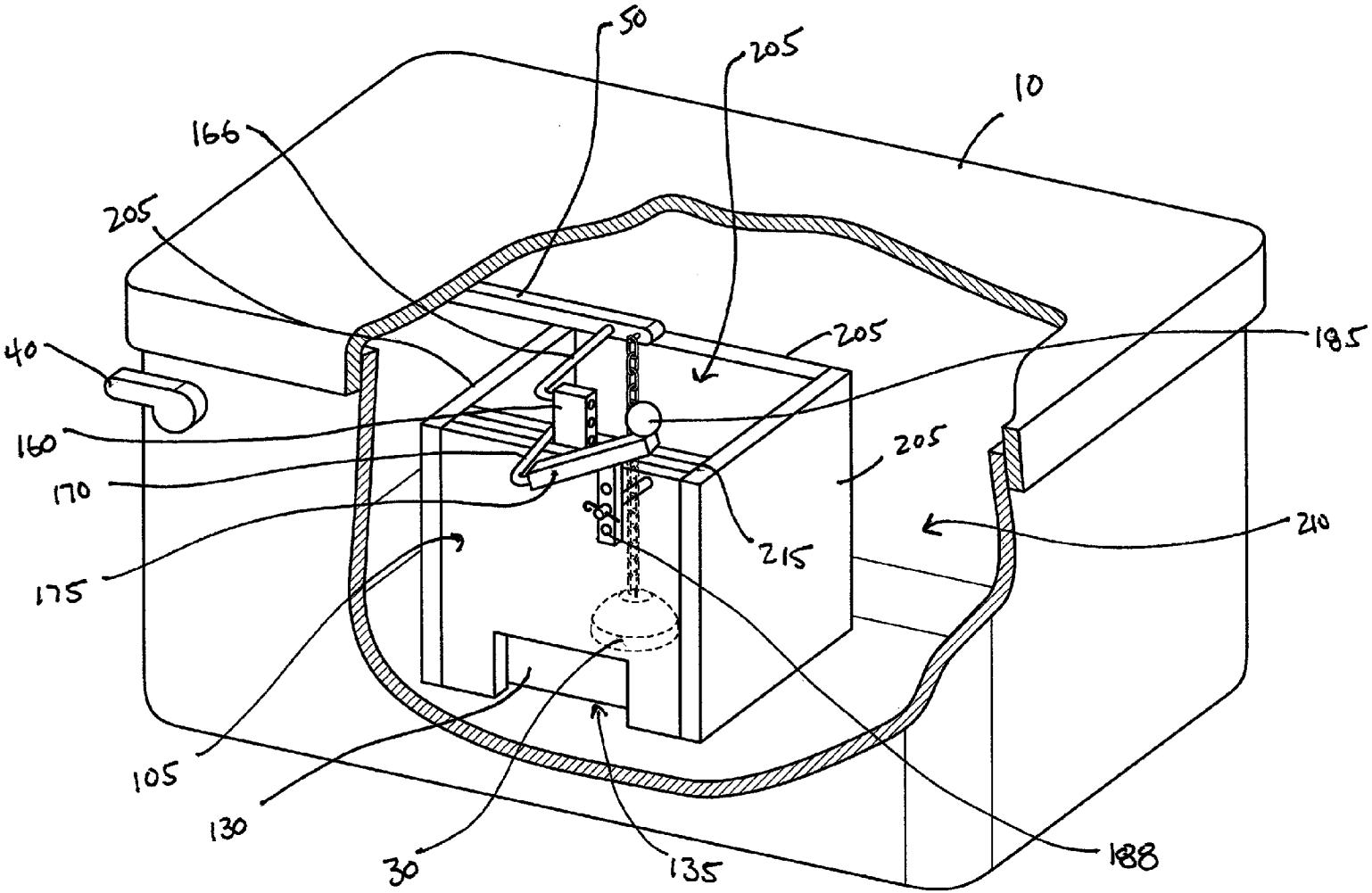
FIG. 5A is a perspective view a second system embodiment made in accordance with one or more principals of the present invention.
Figure 5B:
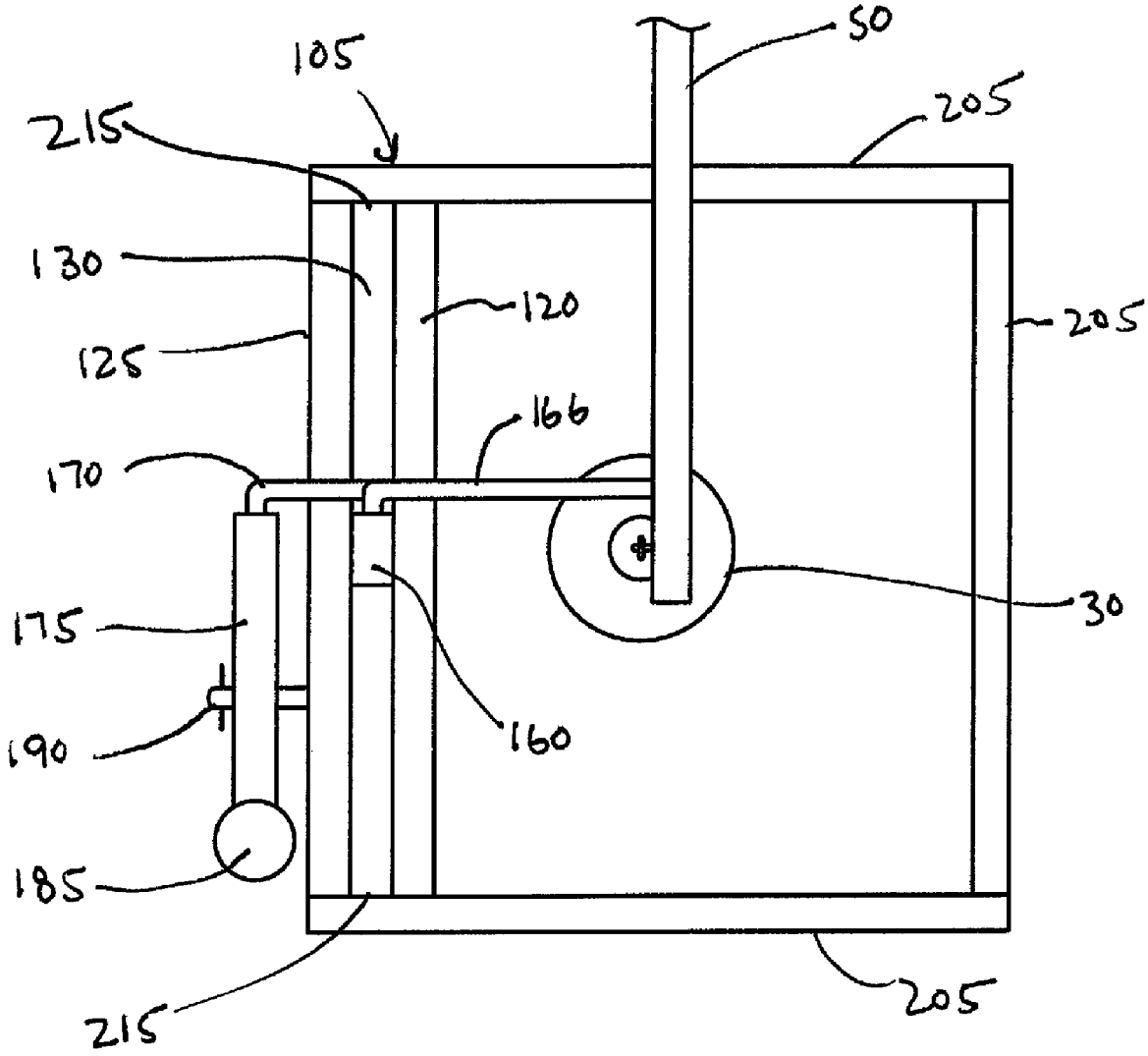
FIG. 5B is a top view of the second system embodiment.
Figure 6A:
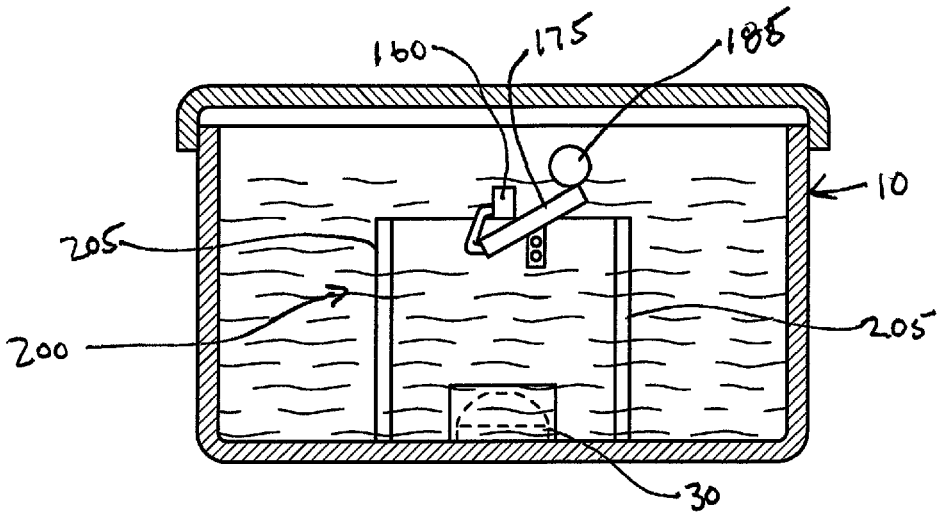
FIG. 6A is a side view of the second system embodiment showing a full water level.
Figure 6B:
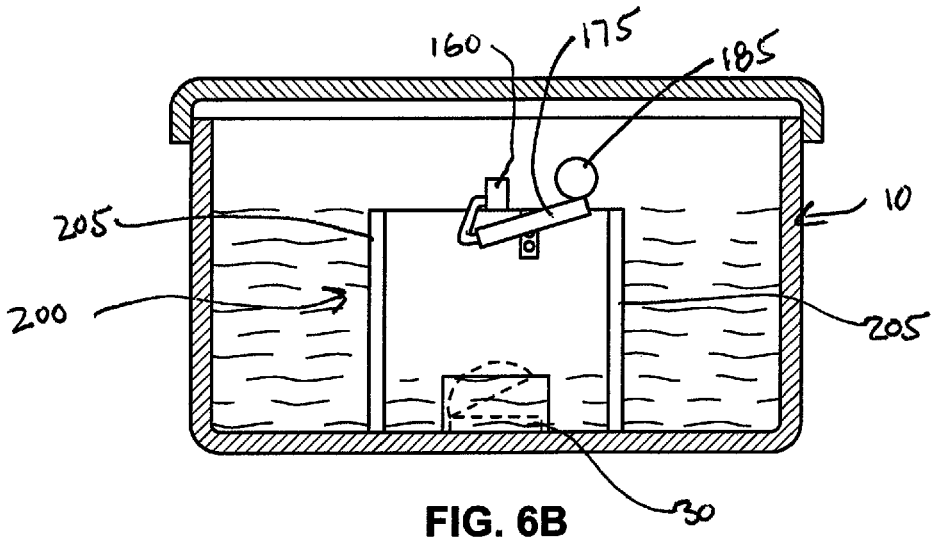
FIG. 6B is a side view of the second system embodiment showing an initial flush and the use of water from the main portion.
Figure 6C:
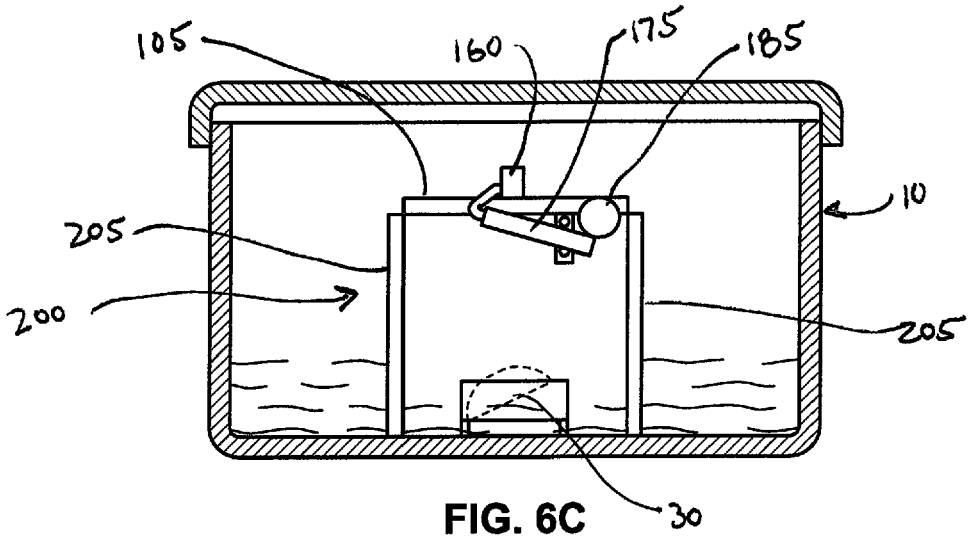
FIG. 6C is a side view of the second system embodiment showing a double flush and the use of water from both the main and reserve portions.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention, claims and/or embodiments illustrated.

Turning now descriptively to the drawings, in which similar reference characters denote similar elements throughout the several views, FIGS. 1A through 4C illustrate a toilet bowl water flow adjustment system 100, which comprises a divider module 105 which separates a holding tank 10 of a toilet into a main portion 20 and a reserve portion 110. The main portion 20 contains the main flapper valve 30 is connected to the handle arm 40 by a conventional flush connector 50. The main flapper valve 30 engages the exit valve 60 of the holding tank 10.

As mentioned, the flow adjustment system 100 includes a divider module 105 that keeps the two tank portions (main portion 20 and the reserve portion 110) in fluid separation from each other. Preferably, the divider module 105 includes a first panel 120 and a second panel 125, with a movable gate panel 130 positioned there between. Both the first and second panels include an aperture 135 positioned near the bottom edge 137 of each panel. However, the location of the aperture 135 may be moved, but it is preferably positioned along the bottom edge 137. The first and second panels include flanged edges 140 extending towards each other, such that the two panels when connected (such as by secured the flanged edges 140 together), the two-piece panel construction creates a cavity traversing from a top edge 143 to the bottom edge 137. The cavity being sized to receive the movable gate panel 130.

In addition to the above, each of the first and second panels 120 and 125 respectively may include a gasket end piece 142 that is able to engage the side walls of the holding tank to help keep the main portion 20 and the reserve portion 110 in fluid separate from each other. The gasket end pieces may be a suitably strip of rubber, vinyl, or similar resilient material, adhesively or otherwise secured in along the side walls of the holding tank. The gasket end pieces 142 may be an important aspect of a retrofit kit in existing toilets. Since toilets have variant holding tank shapes, the gasket end piece could help permit the divider module 105 to fit in virtually any sized holding tank 10.

Similarly, in addition thereto, one or more of the first or second panels 120 or 125 may include an anchor system 145 used to secure the divider 105 in the holding tank 10. The anchor system 145 consists of a pair of suction cups 150 which can laterally move outwardly from the outside edges 147 of the panels 120 125. The suction cups 150 are controlled by turning the knob 152. The knob 152 may simply connect to a rod which extends to a gear that is meshed to a rack and pinion gear. Depending on the direction, turning the knob would either push the suction cups away from the outside edges allowing them to engage the side walls of the tank or pull the suctions cups back towards the outside edges 147.

When the divider 105 is assembled and secured/placed in the holding tank, the movable gate panel 130 is attached to the handle arm 40 by a conventional flush connector 50. Connection to the conventional flush connector 50 is provided by linking the end of the conventional flush connector 50 to a movable gate panel 130 includes a first member 160 protruding from the top edge 162 of the moveable gate panel 130. The first member 160 may include a plurality of openings 164 to adjustably receive the other end of the linkage 166. Further connected to the protruding first member 160 is a second linkage 170 that has another end connected to one end 177 of a lever 175. The second end 179 of the lever 175 is connected to a float 185. In addition, the lever 175 further includes a weighted object 180 that has the freedom to move from one end to the other of the lever 175. The lever 175 is pivotally secured about a portion 186, which may be about the middle region thereof, to a second member 188 which extends and connects to the side panel 120 by a linkage member 190. The second member 188 also provides a plurality of openings such that the lever 175 can be adjusted. The adjustments made by the first member 160 and the second member 188 permit the lever 175 to be adjusted such that the float 185 idly rests on the top of the water level in the holding tank when the holding tank is full of water and the system is at rest.

Operating the present system is efficient and easy and is designed such that any operator (especially children) can use the dual flush aspects of main embodiment. When the handle arm 40 is initially pushed down and released (once) the toilet begins its flushing cycle. The conventional flush connector 50 will pull the main valve flapper 30 and will also pull on the first member 160 causing the movable gate panel 130 to begin moving. When the handle arm 40 is released from the initial flush the water level in the holding tank is still above the divider module 105. The float 185 is therefore kept in its top position which in turn keeps the moveable gate panel 130 in the downward position which keeps the aperture 135 closed separating the main portion 20 from the reserve portion 110. As water flushes from the main portion 20, the water level in both portions drops until the level in the reserve portion 110 is about the same height as the divider module 105. While this could drop the float 185, the weighted object 180 in the lever 175 keeps the lever 175 in a position that holds the float 185 above the water level and thus maintains the moveable gate panel 130 in a closed position.

To operate the present system in a dual flush capacity, the handle arm 40 is initially flushed as mentioned above. Immediately after the initial flush, the operator flushes the handle arm 40 a second time. Because a toilet ejects water quickly, the time between the initial flush and the second flush is sufficient to drop the water level to a position that the second flush will lower the float 185 and angle the lever 175 to a position that the weighted object 180 moves towards the end with the float 185. The second flush will also raise the moveable gate panel 130, which opens the aperture 135 between the main portion 20 and the reserve portion 110. Since the float 185 is in a downward position and the weighted object 180 will keep the float 185 in the downward position, the moveable gate panel 130 will remain open. Therefore the second flush will empty both the main portion 20 and the reserve portion 110.

While the shifting weighted object 180 may be critical for insuring proper close or open of the moveable gate panel 130 consistently, similar results may be achieved by carefully balancing the moveable gate panel, the float, and the forces on the gate provided by the water pressure differential between the main portion 20 and the reserve portion 110.

The system can be made with no or minimum changes to any parts of the conventional toilet. From manufacturers' perspective, no expensive alterations of existing manufacturing assets are required since all existing toilet parts and the expensive equipment with which the toilets are made remain unchanged. In addition, no expensive new equipment is needed since there are no new specialized parts to be made with this mechanism. As a result, a dual flush toilet made with one or more of the aforementioned embodiments is significantly less costly to make than other dual flush toilets currently on the market.

The water quantity saved can be varied by the size of the main portion of the tank and the height of the divider module. In general, the smaller the size of the main portion of the tank is, the more water saving will be (there is a minimum size to be functional), and the taller the divider is, the more water saving will be. However, the maximum height of the divider should be slightly lower than the water level in the toilet tank when the tank is full.

One or more of the embodiments in the present invention includes a control mechanism with which a dual flush retrofit converter and a new model of dual flush toilet can be made. Such dual flush retrofit converter requires no replacement of any parts of the existing toilet (therefore is no risk to consumer should the consumer decide to go back to the original toilet), can be easily installed without professional support, and is user friendly. A dual flush toilet made with the mechanism costs significantly less than other dual flush toilets on the market and they are user friendly.

In another embodiment of the present invention, a retrofit system in accordance to similar principals to one or more of the above embodiments is described and illustrated in FIGS. 5A to 6C. The system 200 fits around the main flapper valve 30 completely enclosing the main flapper valve 30 by three walls 205 and a divider module 105, creating a main portion 205 within the system 200 and a reserve portion 210 outside of the system. The ends 215 of the divider module 105 are connected to edges of two of the walls 205. The operation of the system 200 would work similar to the aforementioned system 100 such that further explanation is not necessary.

Figure 7:
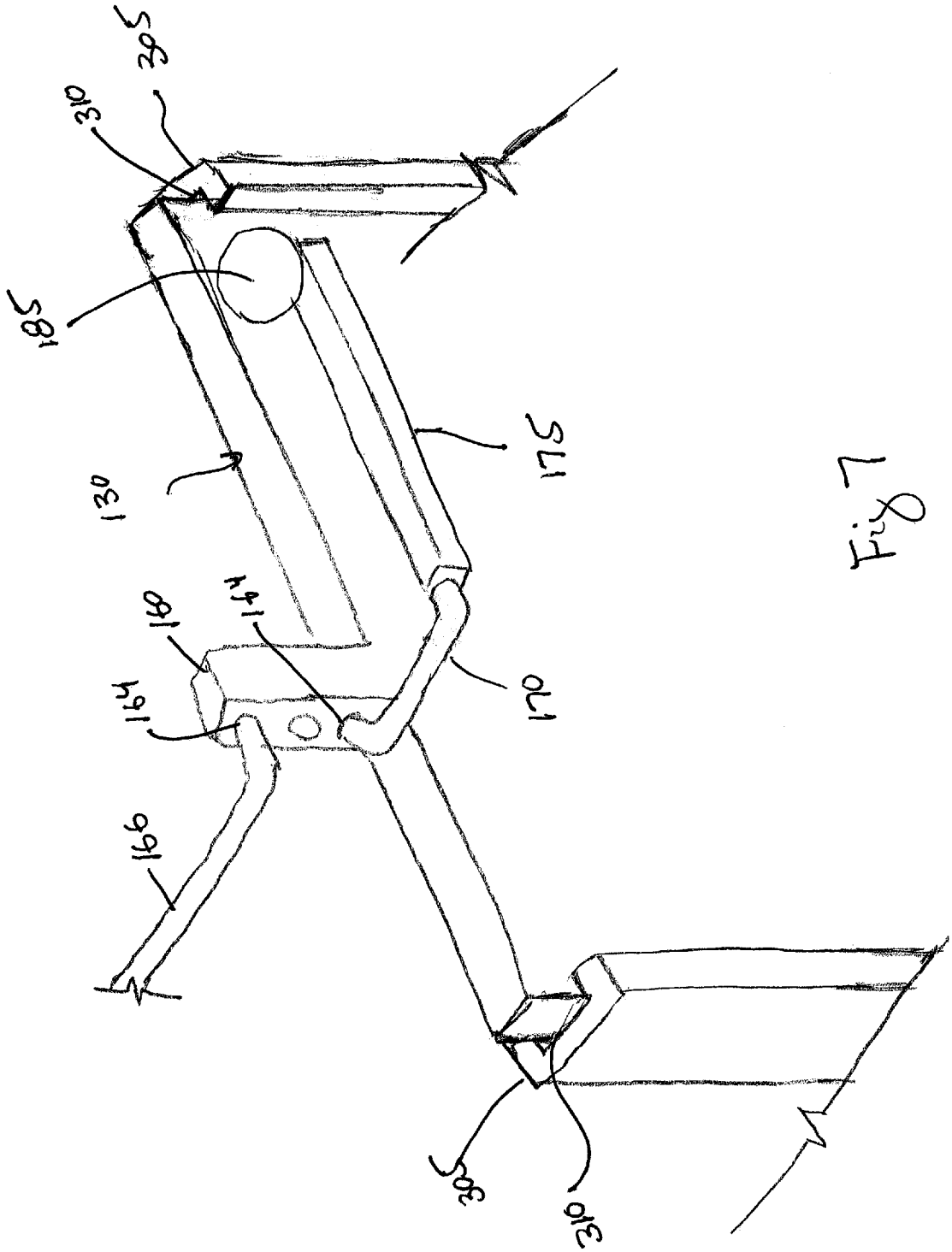
FIG. 7 is an enlarged perspective view of a third system embodiment showing the top portion of a gate panel movable secured in a holding tank by a pair of unshaped side edges.

In another embodiment of the present invention, a retrofit system in accordance to similar principals to one or more of the above embodiments is described and illustrated in FIG. FIG. 7. The system 300 separates the holding tank into two portions, a main portion 20 and a reserve portion 110. The system includes edge portions 305 that are secured to the side walls of the holding tank. Each edge portions 305 includes a channel 310 running along the length thereof. The channels 310 are sized to accommodate the gate panel 130. The gate panel 130 is movably positioned in the edge portions 305 such that operation of the system 300 is similar to the above embodiments. A single or initial flush uses the water in the main portion, while a double flush, cause the gate panel 130 to be maintained off of the bottom wall of the holding tank, allowing the system to use the water from both the main portion and the reserve portion 110. In other variant systems, the system 300 may also include a bottom portion having a channel sized to receive the bottom of the gate panel 130. This helps ensures that the main portion and the reserve portion are in fluid separation of each other.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover all such modifications.

We claim:

1. A toilet water flow adjustment system for usage within a toilet, the toilet having a handle arm connected to a flush connector, which when the handle arm is depressed a main flapper valve opens to flush the toilet, the system comprising:

a divider positionable within a holding tank, defined by the toilet, in a substantially vertical orientation, the divider having a height lower than a full water level in the holding tank and the divider separating the holding tank into a main portion and a reserve portion, wherein the main portion contains the main flapper valve;

the divider defined as including a gate panel positioned against at least one side panel, the side panel including an aperture and the gate panel further being vertically movable with respect to the at least one side panel for providing selective fluid connection between the main portion and the reserve portion;

a first linkage connecting the gate panel to the flush connector such that when the handle arm is depressed, the gate panel moves towards an upward position;

a lever having a weighted object freely moveably secured thereto, the lever having one end connected to the gate panel and having another end connected to a float, the lever is further pivotally connected about a region intermediate to the two ends to the at least one side panel, such that when the gate panel moves towards an upward position the float moves towards a downward position, the float being positioned within the reserve portion, or above the divider, or within the main portion and maintains a floating position on the full water level above the height of the divider;

wherein when the handle arm is initially depressed the gate panel being initially urged towards an upward position returns to a downward position sealing the aperture in the divider as the float maintains its floating position on top of the full water level and as the weighted object substantially remains at the end connected to the gate panel such that the water in the main portion is utilized to flush the toilet reserving water in the reserve portion which also drops the water level in the holding tank to the height of the divider, and when the handle arm is depressed a second time in the same manner as the initial depression the gate panel is moved towards an upward position dropping the float to a position about the height of the divider and the weighted object moves towards the end of the lever connected to the float maintaining the gate panel in an upward position opening the aperture in the side panel such that the water in the reserve portion and the main portion is utilized to flush the toilet.

2. The system of claim 1, wherein the side panel includes an aperture, such that when the gate panel is moved towards an upward position, the aperture becomes uncovered providing for the fluid connection between the main portion and the reserve portion.

3. The system of claim 2, wherein the aperture is positioned along a bottom edge of the side panel or at the end of the side panel.

4. The system of claim 2, wherein the vertical orientated divider further includes a second side panel, wherein the at least two side panels are separately positioned on either side of the gate panel, each side panel having an aperture defined to provide fluid connection between the main portion and the reserve portion when the gate panel is maintained in an upward position.

5. The system of claim 4, wherein the two side panels each include flanged edges extending towards each other, such that when the flanged edges of the two side panels are secured together, the two side panels create a cavity and wherein the cavity is sized to receive the gate panel.

6. The system of claim 1 or 4 wherein each side panel has a pair of ends positioned to engage a side wall of the holding tank such that when engaged the side panel fluidly separates the holding tank into the main portion and the reserve portion, the pair of ends further includes a gasket secured there along to facilitate the fluid separation.

7. The system of claim 1 or 4 wherein each side panel further includes an anchor system to secure the divider in the holding tank.

8. The system of claim 1, wherein the gate panel includes a first member protruding upwardly from a top edge of the gate panel and the first member being secured to the first linkage.

9. The system of claim 8, wherein the first member includes a plurality of openings to adjustably secure the first linkage thereto.

10. The system of claim 1, wherein the end of the lever distal to the end connected to the float is connected to a second linkage which connects to the gate panel.

11. The system of claim 1, wherein the pivotal connection about the region intermediate to the two ends of the lever includes a third linkage connecting the intermediate region to the at least one side panel and is an adjustable connection.

12. A toilet water flow adjustment system for usage within a toilet, the toilet having a handle arm connected to a flush connector, which when the handle arm is depressed a main flapper valve opens to flush the toilet, the system comprising:

a divider positionable within a holding tank, defined by the toilet, in a substantially vertical orientation, the divider having a height lower than a full water level in the holding tank and the divider separating the holding tank into a main portion and a reserve portion, wherein the main portion contains the main flapper valve;

the divider defined as including a gate panel positioned against at least one side panel, the side panel including an aperture and the gate panel further being vertically movable with respect to the at least one side panel for providing selective fluid connection between the main portion and the reserve portion;

a first linkage connecting the gate panel to the flush connector such that when the handle arm is depressed, the gate panel moves towards an upward position;

a lever having one end connected to the gate panel and having another end connected to a float, the lever is further pivotally connected about a region intermediate to the two ends to the at least one side panel, such that when the gate panel moves towards an upward position the float moves towards a downward position, the float being positioned within the reserve portion, or above the divider, or within the main portion and maintains a floating position on the full water level above the height of the divider, and wherein the lever has a weighted object freely moveably secured thereto;

whereby pressing the handle arm an initial time selectively keeps the gate panel in a downward position such that water in the main portion is utilized to flush the toilet reserving water in the reserve portion, and pressing the handle arm a second time in the same manner as the initial time moves and keeps the gate panel in an upward position such that water in the reserve portion and the main portion is utilized to flush the toilet.

13. The system of claim 12 wherein the side panel has a pair of ends positioned to engage a side wall of the holding tank such that when engaged the side panel fluidly separates the holding tank into the main portion and the reserve portion, the pair of ends further includes a gasket secured there along to facilitate the fluid separation.

14. The system of claim 13, wherein the gate panel includes a first member protruding upwardly from a top edge of the gate panel and the first member being secured to the first linkage and the first member has an adjustable connection to the first linkage.

15. The system of claim 14, wherein the end of the lever distal to the end connected to the float is connected to a second linkage which connects to the gate panel.

16. The system of claim 15, wherein the pivotal connection about the region intermediate to the two ends of the lever includes a third linkage connecting the intermediate region to the at least one side panel and is an adjustable connection.

* * * * *